United States Patent [19]

Bachner

[11] Patent Number: 4,714,164

[45] Date of Patent: Dec. 22, 1987

[54] STACKING TAB FOR TAPERED CONTAINER

[75] Inventor: George Bachner, Barrington, Ill.

[73] Assignee: Nimco Corporation, Crystal Lake, Ill.

[21] Appl. No.: 809,935

[22] Filed: Dec. 16, 1985

[51] Int. Cl.[4] ..... B65D 21/02

[52] U.S. Cl. ..... 206/518; 206/519; 206/631.3; 229/114; 229/915; 229/DIG. 11; 229/920; 229/106; 229/4.5; 229/52 B; 493/63; 493/133; 493/295

[58] Field of Search ..... 206/518, 519, 499; 229/17 R, 17 G, 915, DIG. 11, 1.5 B, 114, 917, 485 A, 48 T, 920; 493/63, 295, 133–135, 296; 383/903

[56] References Cited

U.S. PATENT DOCUMENTS

| | | | |
|---|---|---|---|
| 366,049 | 7/1887 | Walsh | 206/519 |
| 1,326,519 | 12/1919 | McLaren | 206/499 |
| 1,944,621 | 1/1934 | Atta | 383/903 |
| 3,208,631 | 9/1965 | Edwards | 206/519 |
| 3,529,743 | 9/1970 | Ehrbar et al. | 206/519 |
| 3,568,910 | 3/1971 | McConnell | 229/17 R |
| 3,827,620 | 8/1974 | Ludder | 229/1.5 B |
| 4,498,585 | 2/1985 | Gordon et al. | 229/17 G |

FOREIGN PATENT DOCUMENTS

| | | | |
|---|---|---|---|
| 2109956 | 9/1972 | Fed. Rep. of Germany | 206/519 |
| 198037 | 5/1923 | United Kingdom | 206/519 |
| 518327 | 2/1940 | United Kingdom | 206/519 |

*Primary Examiner*—Stephen Marcus
*Assistant Examiner*—Gary E. Elkins
*Attorney, Agent, or Firm*—Kirkland & Ellis

[57] ABSTRACT

A carton blank and method for forming a liquid-tight tapered container having a denesting tab. When the blank is folded and sealed to form an open-topped tapered container, a destacking tab is formed as a result of abhesion. The tab facilitates destacking a single container from a stack of like containers prior to their filling and final closure.

32 Claims, 11 Drawing Figures

FIG. 1
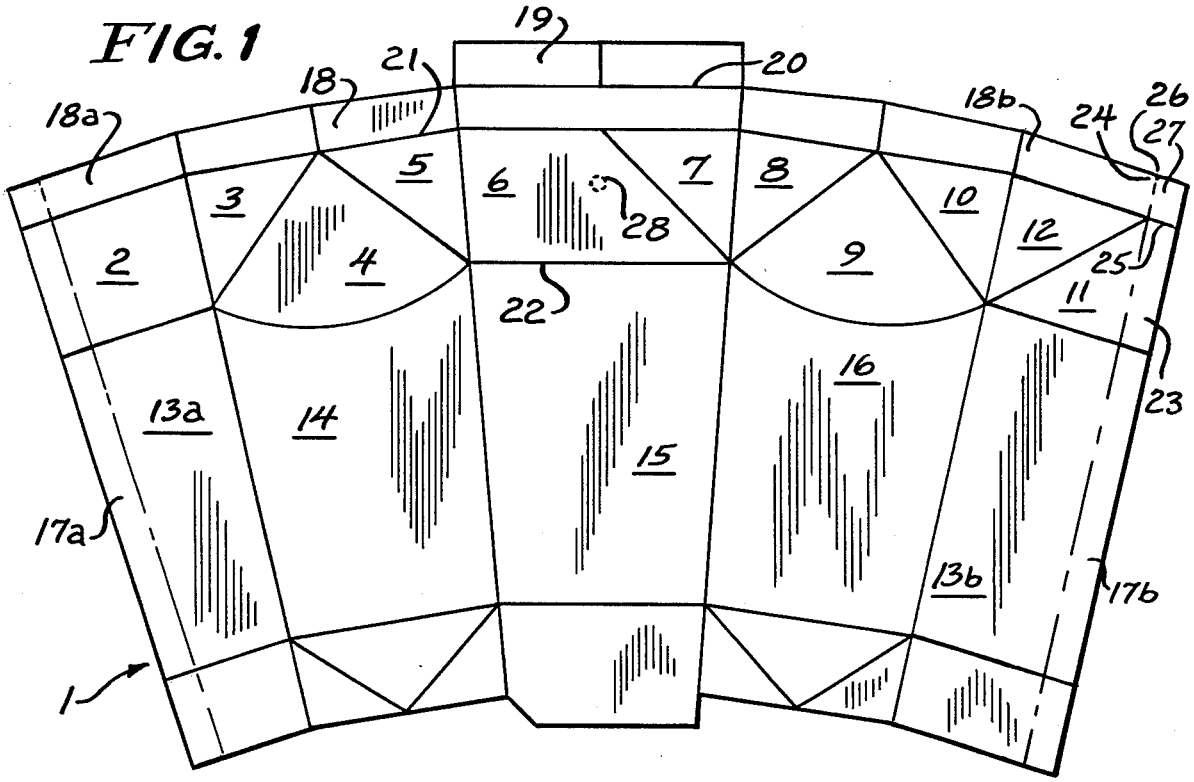
FIG. 3
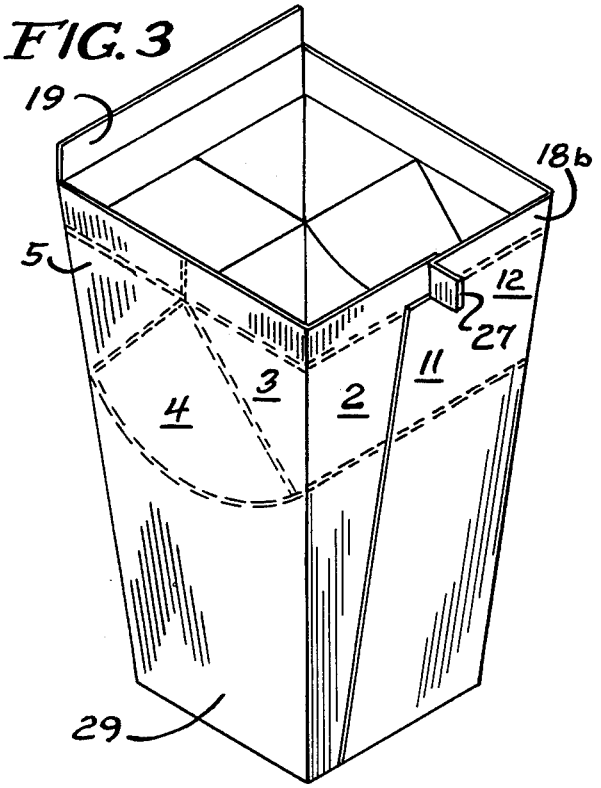
FIG. 2
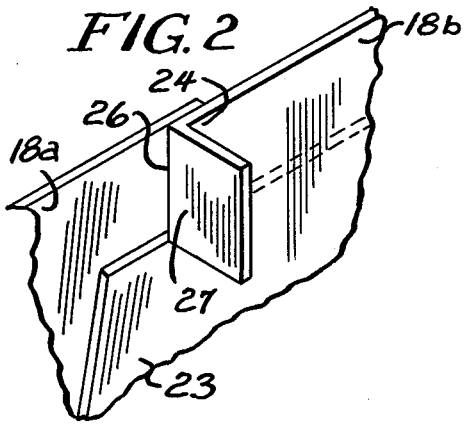
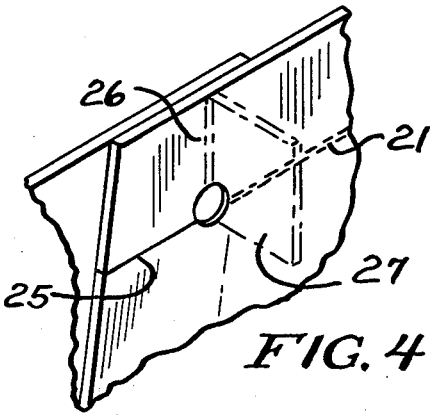
FIG. 4

FIG. 5
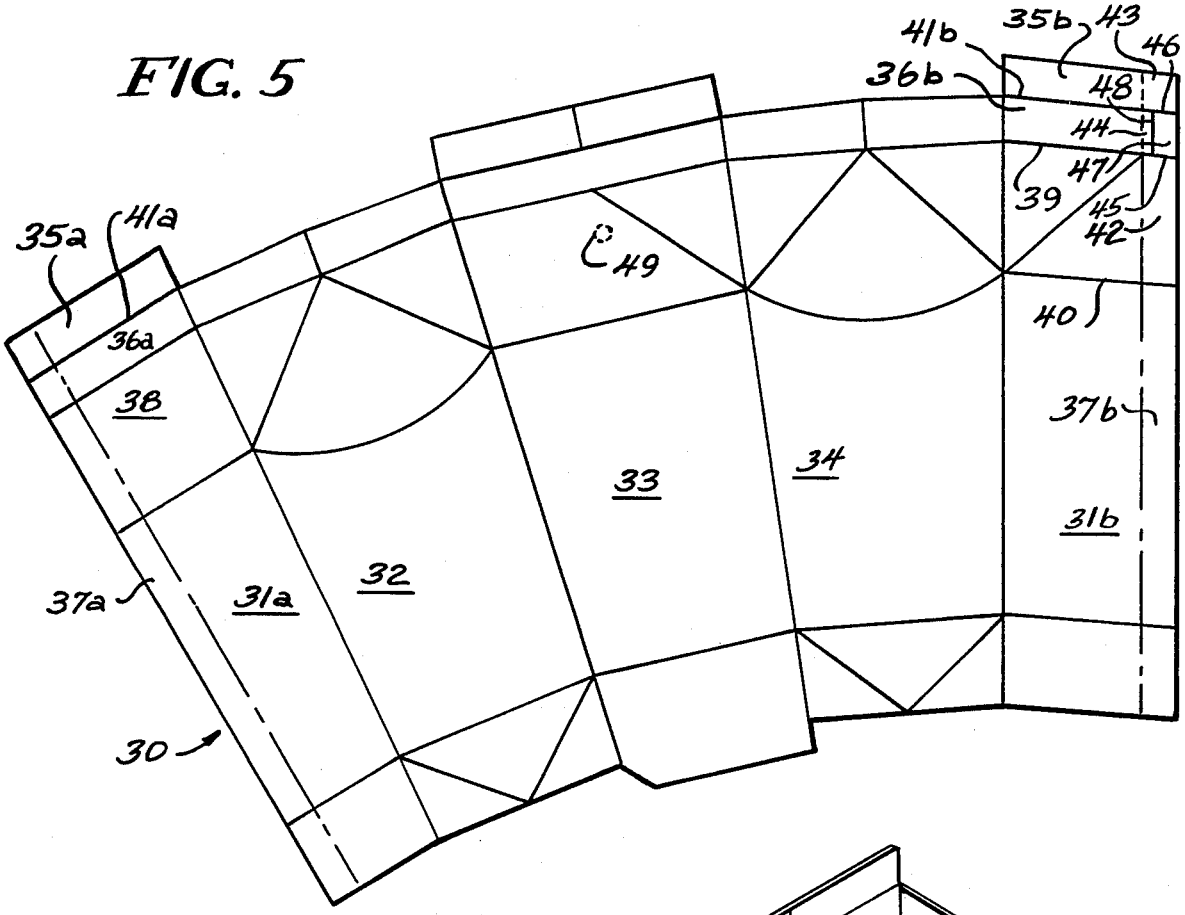
FIG. 6
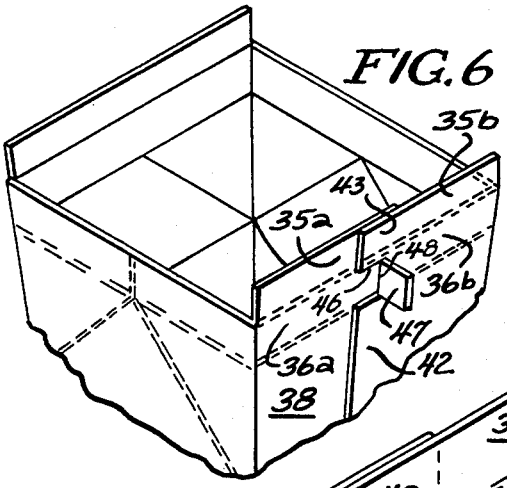
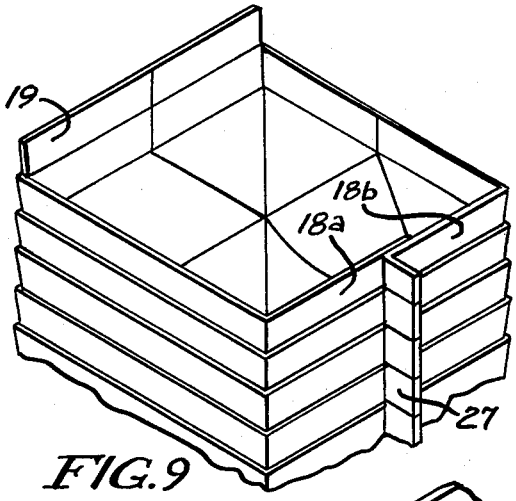
FIG. 9
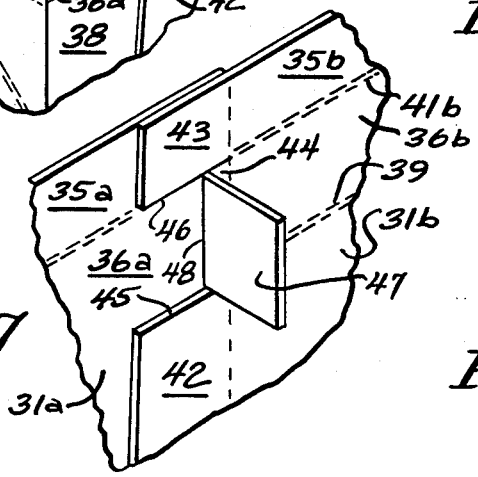
FIG. 7
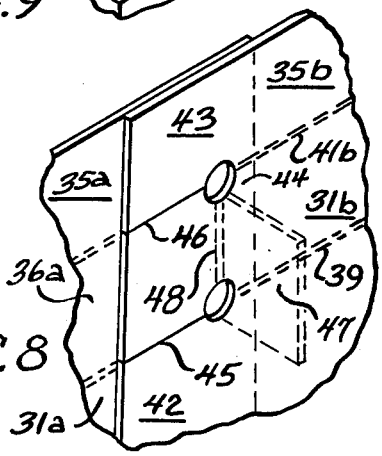
FIG. 8

STACKING TAB FOR TAPERED CONTAINER

BACKGROUND OF THE INVENTION

1. Field of the Invention

This invention relates to paperboard containers and more particularly to tapered paperboard containers, examples of which are disposable containers for storage and distribution of solid or liquid food products.

2. Description of the Prior Art

Tapered disposable paperboard containers are widely used in the food industry to package beverages and solid food. Containers are formed from blanks cut from large paperboard sheets. Tapered containers which have been sealed at the side seam and bottom seams are typically stacked for storage, shipment and dispensing prior to filling and sealing.

The paperboard from which the containers are constructed is often coated with a layer of thermoplastic material such as polyethelene on the surface of the carton blank which forms the inside of the container. In areas where the paperboard is overlapped to form a seam, typically both the surfaces in contact are coated with the thermoplastic material to facilitate sealing. Frequently the entire area of both the inner surface and the outer surface are coated with thermoplastic material.

Containers made of coated or uncoated paperboard, when stacked, become difficult to pull apart as a result of successive pressures applied during stacking, the cumulative weight of stacked containers, and friction between the outer surface of a next upper container and the inner surface of a next lower container in a stack. Local atmospheric variables such as temperature and humidity also affect the tendency of stacked tapered containers to resist destacking.

In the past this difficulty of destacking tapered paperboard containers was somewhat overcome by forming tapered containers with a horizontally protruding convexity at one of the upper carton surfaces. The convexity provided a resting ledge between cartons to receive the weight and pressure of stacked cartons independent of the carton wall surfaces. The convexity further provided a graspable protrusion for lifting the cartons away from the cartons of the stack. Such a convexity is disclosed in Gordon, U.S. Pat. No. 4,498,585. In comparison to a conventional tapered carton formed from a conventional carton blank, formation and use of the convexity described in Gordon poses several problems. First, the manufacture of these destackable tapered cartons from flat carton blanks requires a time-consuming and relatively complex step of creating the convexity by forming at least two seals which are not formed in a conventional carton. Second, the convexity necessitates use of a carton blank having at least one flap in addition to the flaps of a conventional carton blank. These differences between the conventional tapered carton and the carton having a destacking convexity require use of modified assembly equipment and performance of several additional assembly steps rendering the formation of such cartons more expensive and time consuming than formation of conventional cartons. Also, the convexity made of paperboard is subject to flatening during handling and stacking such that it becomes deformed, non-protruding and non-functional, causing the stacked cartons to adhere even more tightly due to the added horizontal pressure created by the additional thickness of the deformed convexity between stacked cartons. Moreover, the presence of the convexity impedes the final top closing of the carton because a closure flap must fold over and crush the convexity during closing.

The present invention overcomes the disadvantages of the prior art and obviates the difficulties, extra time and expense of the convexity destacking feature by providing a novel, tapered carton blank uniquely scored and cut, and a novel method of folding and sealing the carton blank to form a carton having a novel destacking feature which does not require additional flaps or additional paperboard, does not require additional sealing steps, is resistant to deformation, and does not impede the final closing of the carton.

SUMMARY OF THE INVENTION

The present invention comprises a novel tapered carton blank uniquely scored and cut and a novel method of folding and sealing the tapered carton blank to form a tapered container having a novel destacking feature.

The paperboard carton blank of the present invention is substantially similar to the carton blank of any conventional tapered carton except in the present invention a small rectangular area of the undersurface of one of the top sealing panels is made abhesive. When the blank is folded and sealed to form an open-topped tappered container a destacking tab is formed as a result of abhesion and is folded to protrude. Its function is to form a horizontally protruding vertical surface with substantially horizontal top and bottom edges adapted to receive the weight and pressure of stacked cartons substantially independent of the inner and outer wall surfaces of each carton. The protruding tab further functions as a graspable handle for lifting each carton away from the cartons of the stack.

The scoring pattern for the tapered carton blank of the present invention is substantially similar to the scoring pattern of any conventional tapered carton except the carton blank of the present invention has a new fold line in a top sealing panel running perpendicular to the length of the top sealing panel and either one or two slits each running perpendicular to the new fold line and parallel to the top sealing panel.

The blank of the present invention in a preferred embodiment has a slit running parallel to the length of a top sealing panel along the fold line between the top sealing panel and a top closure panel. The new fold line, slit and two outer edges of a top sealing panel define a substantially rectangular area. The width of the substantially rectangular area, as measured along the edges perpendicular to the fold line is less than the width of the overlap at the side seam of the carton, as measured perpendicularly to the length of the side seam.

In an alternative embodiment the blank of the present invention has two slits running parallel to the length of a top sealing panel. One slit runs along the fold line between the top seal flap and a top sealing panel and the other slit runs along the fold line between a top sealing panel and a top closure panel. The new fold line, slits and outer edge of a top sealing panel define a substantially rectangular area. The width of the substantially rectangular area as measured along the edges perpendicular to the fold line, is less than the width of the overlap at the side seam of the carton, as measured perpendicularly to the length of the side seam.

The added fold line, slit or slits, and abhesive rectangular inner surface of each embodiment facilitate a new fold whereby a protruding tab is formed having horizontal top and bottom surfaces.

The protruding tab is formed by folding and sealing the carton in a substantially conventional manner except that the sealed portion of the side seam overlap which is in the tp sealing panel in either embodiment has a width narrower than the width of the sealed side seam overlap in the remaining portion of the side seam. The destacking tab is formed by folding the rectangular abhesive area along a new fold line to create a protruding, substantially rectangular tab.

When tapered cartons formed by this method are stacked, the bottom edge of the tab perpendicularly contacts the upper edge of the next lower carton in the stack. The weight and pressure of stacked cartons is received at this point of contact. The weight and pressure of stacked cartons without the present invention would be received over the inner and outer surfaces of the wall panels of the carton.

An object of the present invention is to eliminate friction and pressure over a relatively large, substantially vertical wall surface area and replace it with contact at a small horizontal area.

Another object of the present invention is to teach a method of cutting, scoring, folding and sealing a carton blank to create a carton having a unique destacking tab feature.

Another object of the present invention is to provide a destacking feature which does not require the use of additional paperboard, does not require an additional flap, is not prone to deformation during handling, does not impede the final closing of the container, and will not increase resistance to destacking if it does become deformed during handling.

Other objects and advantages of the present invention will be apparent from the following descriptions and accompanying drawings of the preferred embodiment and alternate embodiments of the present invention.

BRIEF DESCRIPTION OF THE DRAWINGS

In the Drawings

FIG. 1 is a top plan view of a rectangular bottom carton blank and scoring pattern of the preferred embodiment of the present invention;

FIG. 2 is a prospective view of a rectangular bototm carton incorporating the preferred embodiment of the present invention in its final configuration after folding;

FIG. 3 is a prospective detail of the preferred embodiment of the destacking tab of the present invention in its final configuration after folding;

FIG. 4 is a prospective detail of a first alternative embodiment of the destacking tab of the present invention in its final configuration after folding;

FIG. 5 is a top plan view of a rectangular bottom carton blank and scoring pattern of a second alternative embodiment of the present invention;

FIG. 6 is a prospective view of the second alternative embodiment of the destacking tab of the present invention in its final configuration after folding;

FIG. 7 is a prospective detail of the second alternative embodiment of the destacking tab of the present invention in its final configuration after folding;

FIG. 8 is a prospective detail of a third alternative embodiment of the destacking tab of the present invention in its final configuration after formation and folding;

FIG. 9 is a prospective view of stacked tapered cartons employing the destacking tab of the preferred embodiment of the present invention;

DETAILED DESCRIPTION OF THE INVENTION

Figure 10:
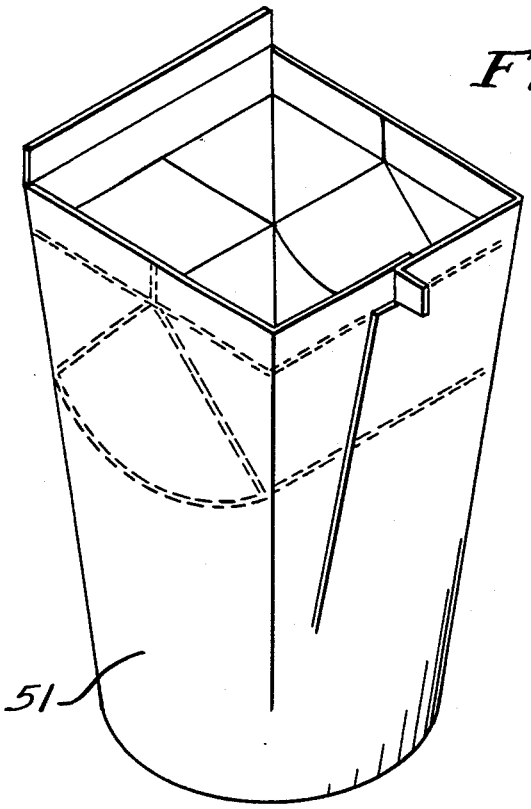
FIG. 10 is a prospective view of a round bottom carton incorporating the preferred embodiment of the present invention in its final configuration after folding.

Referring to FIGS. 1–4 and more particularly to FIG. 1, carton blank 1 comprises a top closure panel arrangement 2–12 known as the clef seal type and wall panels 13, 14, 15 and 16. In the embodiment illustrated in FIG. 1, wall panel 13 is comprised of a left-hand portion 13*a* and a right-hand portion 13*b*. Side seam panel 17 is comprised of a left-hand underlapping portion 17*a* and a right-hand overlapping portion 17*b*. Side seam panel 17 extends the entire length of the carton blank. Carton blank 1 can be folded and then sealed along side seam panel 17 by folding wall panel 13*b* over wall panel 13*a* so that side seam panel 17*b* overlaps side seam panel 17*a* to form a tubular body. Top seal panel 18 is separated from top seal flap 19 by fold line 20. Top seal panel 18 is separated from top closure panels 2, 3, 5, 6, 7, 8, 10 and 12 by fold line 21. Top closure panels 2, 4, 6, 9 and 11 are separated from wall panels 13*a*, 14, 15, 16 and 13*b* by fold line 22. Side seam panel 17 is perpendicularly traversed by fold lines 21 and 22. Top closure panel 6 is provided with a circular partially perforated score line 28 which, when ruptured, forms a hole adapted to receive a straw.

Wall panels 13*a* and 13*b* are sealed along side seam panel 17. The width of the overlap 23 where wall panel 13*b* overlaps wall panel 13*a* below fold line 21 in side seam panel 17 is greater than the width of the overlap 24 where top seal panel 18*b* overlaps top seal panel 18*a* in side seam panel 17 above fold line 21, above slit 25, and to the right of fold line 26, because the abhesive surface of destacking tab 27, defined by fold line 26 and slit 25, prevents the sealing of this surface during the sealing of seam panel 17. Folding along fold line 26, permitted by slit 25, places the destacking tab 27 in its protruding, functional position.

FIG. 2, with numbers corresponding to those of FIG. 1 illustrates, in detail, destacking tab 27 in its protruding, functional position.

FIG. 3, with numbers corresponding to those of FIGS. 1 and 2 illustrates destacking tab 27 in its protruding, functional position employed in a tapered carton having a rectangular bottom closure 29.

FIG. 4, with numbers corresponding to those of FIGS. 1, 2 and 3 illustrates an alternative embodiment of the present invention. At the intersection of slit 25 and fold line 26 a hole is punched in the carton blank. The hole helps avoid tearing near the destacking tab 27 by reducing stress and facilitating the folding of the paperboard at the intersection of slit 25 and fold line 26.

Referring to FIGS. 5–7 and more particularly to FIG. 5, carton blank 30 comprises another top closure panel arrangement known as the top seal type and wall panels 31, 32, 33, and 34. In the embodiment illustrated in FIG. 5, wall panel 31 is comprised of a left-hand portion 31*a* and a right-hand portion 31*b*. Carton blank 30 (the top seal type) differs from carton blank 1 (the clef seal type) in that carton blank 30 includes a left top seal flap 35*a* and a right top seal flap 35*b* as additions to and in connection with top seal panel 36. An example of a carton blank of the top seal type tapered carton is shown in FIG. 8 of U.S. patent application Ser. No. 584,869 filed Feb. 29, 1984 now U.S. Pat. No. 4,601,425. An example of a carton blank of the clef seal type tapered carton is shown in FIG. 9 of the foregoing application.

Carton blank 30 can be folded and sealed along side seam panel 37. Side seam panel 37 is comprised of a left-hand underlapping portion 37*a* and a right-hand overlapping portion 37*b*. Side seam panel 37 extends the entire length of the carton blank to form a tubular body. Top seal panel 36 and top closure panel 38 are separated by horizontal fold line 39. Top closure panel 38 and wall panel 31 are separated by horizontal fold line 40. Left top seal flap 35*a* and left top seal panel 36*a* are separated by horizontal fold line 41*a*. Right top seal flap 35*b* and left top seal panel 36*b* are separated by horizontal fold line 41*b*. The side seam panel 37 is perpendicularly traversed by horizontal fold lines 39, 40, 41*a* and 41*b*.

Referring particularly to FIG. 6, the width of overlap 42 where wall panel 31*b* overlaps wall panel 31*a* in side seam panel 37 below fold line 39, and the width of overlap 43 where top closure flap 35*b* overlaps top closure flap 35*a* in side seam panel 37 above fold line 41, are each greater than the width of overlap 44 where top seal panel 36*b* overlaps top seal panel 36*a* in side seam panel 37 above fold line 39 and below fold line 41 above slit 45 and below slit 46 because the abhesive inner surface of destacking tab 47 prevents sealing of this surface during the sealing of side seam panel 37. Folding along fold line 48, permitted by slits 45 and 46, places the destacking tab 47 of this embodiment of the present invention in its protruding, functional position.

Top closure panel 38 includes a score line 49 for forming an aperture which is adopted to receive a straw therethrough for access to the contents of a closed container.

FIG. 7, with numbers corresponding to those of FIGS. 5 and 6 illustrates, in detail, destacking tab 47 in its protruding fuctional position in a container having a top closure panel arrangement known as the top seal type.

FIG. 8, with numbers corresponding to those of FIGS. 5, 6 and 7 illustrates a further alternative embodiment of the present invention. At the intersection of slit 45 and fold line 48 and at the intersection of slit 46 and fold line 48, the carton blank is punched to create one or more holes as described above with respect to the second alternative embodiment.

FIG. 9 with numbers corresponding to those of FIGS. 1, 2, 3 and 4, shows stacked, tapered clef seal type cartons employing destacking tab 27 of the preferred embodiment of the present invention.

FIG. 10, with numbers corresponding to those of FIGS. 1, 2, 3 and 4 illustrates destacking tab 27 in its protruding functional position employed in a tapered top seal type carton having a round-bottom closure arrangement 51.

Figure 11:
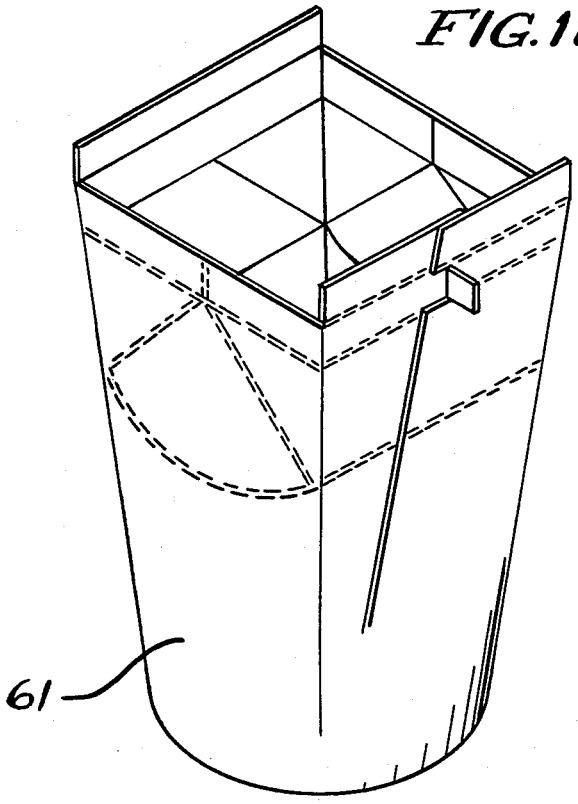
FIG. 11 is a prospective view of a round bottom carton incorporating the second alternative embodiment of the present invention in its final configuration after folding.

FIG. 11, with numbers corresponding to those of FIGS. 5, 6, 7 and 8 illustrates destacking tab 47 in its protruding functional position employed in a clef seal type tapered carton having a round-bottom closure arrangement 61.

While the foregoing embodiments are intended to illustrate a carton blank and method of folding and sealing a carton blank to form a tapered container having a novel destacking feature, they are not intended nor should they be construed as limitations on the invention. As one skilled in the art would understand, many variations and modifications of these embodiments may be made which fall within the spirit and scope of this invention.

I claim:

1. In a blank of foldable sheet material for a container having a tapered body and bottom closure arrangement, said blank having a side seam area for underlapping and a side seam area for overlapping, the underlapping and overlapping forming a sealed side seam area extending the length of said body, a destacking tab comprising:

a substantially rectangular abhesive area within said overlapping side seam area, said abhesive area adapted to resist sealing during formation of said sealed side seam area and adapted for folding to protrude in an erect position relative to said sealed side seam area upon sealing, said abhesive area having a width less than the width of said side seam area for overlapping whereby a continuous sealed side seam area is formable upon lapping and sealing.

2. In a blank of foldable sheet material for a container having a tapered body and a liquid-tight bottom closure arrangement, said body being joined along fold lines to first, second, third and fourth top closure panel arrangements, said top closure panel arrangements each joined by a fold line to the arrangements adjacent to it, said fourth top closure panel arrangement having a first side seam area for overlapping, said top closure panel arrangements being joined along fold lines to first, second, third and fourth top seal closure panels, said first, second and third top seal closure panels each joined by a fold line to the top seal closure panels adjacent to it, said fourth top seal closure panel having a right-hand portion for overlapping and a left-hand portion for underlapping, said second and fourth top seal closure panels being joined along horizontal fold lines to first and second top seal flaps respectively, said second top seal flap having a second side seam area for overlapping, said right-hand portion of said fourth top seal closure panel joined by a first substantially vertical fold line to a destacking feature comprising:

a third side seam area for overlapping, said third side seam area for overlapping being joined along a second substantially vertical fold line to a substantially vertical first edge of a planer, substantially rectangular foldably mounted destacking tab, said destacking tab having a horizontally measured width equal to the horizontally measured width of said first side seam area for overlapping less the horizontally measured width of said third side seam area for overlapping, said destacking tab having an abhesive undersurface, said destacking tab having a substantially horizontal second edge defined by a first fold line between said fourth top seal closure panel and said top seal flap, said first fold line having a first slit in it, said first slit extending the width of said destacking tab, said destacking tab having a substantially vertical third edge parallel to said first edge, said destacking tab having a fourth edge defined by a second fold line between said fourth top closure panel arrangement and said fourth top seal closure panel, said second fold line having a second slit in it, said second slit extending the width of said destacking tab, said second slit being parallel to said first slit, said fourth edge being parallel to said second edge.

3. In the blank of claim 2, the destacking feature of claim 2 wherein said destacking tab has a perforation at the intersection of said first edge and said fourth edge.

4. In the blank of claim 2, the destacking feature of claim 2 wherein said destacking tab has a perforation at the intersection of said first edge and said second edge.

5. In the blank of claim 2, the destacking feature of claim 2, wherein said destacking tab has a first perforation at the intersection of said first edge and said fourth edge and wherein said destacking tab has a second perforation at the intersection of said first edge and said second edge.

6. The blank of claim 2 wherein one of said top closure panels includes a score line for forming an aperture which is adapted to receive a straw therethrough for access to the contents of the container.

7. In a blank of foldable sheet material for a tapered container having first, second, third and fourth wall panels, each joined by a fold line to the panels adjacent to it and also joined by fold lines to a liquid tight rectangular bottom closure arrangement, said fourth wall panel having a first side seam area for overlapping, said wall panels being joined along fold lines to first, second, third, and fourth top closure panel arrangements, said top closure panel arrangements each joined by a fold line to the arrangements adjacent to it, said fourth top closure panel arrangement having a second side seam area for overlapping, said top closure panel arrangements being joined along fold lines to first, second, third and fourth top seal closure panels, said first, second and third top seal closure panels each joined by a fold line to the top seal closure panels adjacent to it, said fourth top seal closure panel having a right-hand portion for overlapping and a left-hand portion for underlapping, said second and fourth top seal closure panels being joined along horizontal fold lines to first and second top seal flaps respectively, said second top seal flap having a third side seam area for overlapping, said right-hand portion of said fourth top seal closure panel being joined by a first substantially vertical fold line to a destacking feature comprising:

a fourth side seam area for overlapping, said fourth side seam area for overlapping being joined along a second substantially vertical fold line to a substantially vertical first edge of a planer, substantially rectangular, foldably mounted destacking tab, said destacking tab having a horizontally measured width equal to the horizontally measured width of said second overlapping side seam area less the horizontally measured width of said third overlapping side seam area, said destacking tab having an abhesive undersurface, said destacking tab having a substantially horizontal second edge defined by a first fold line between said fourth top seal closure panel and said second top seal flap, said first fold line having a first slit in it, said first slip extending the width of said destacking tab, said destacking tab having a third substantially vertical edge parallel to said first edge, said destacking tab having a fourth edge defined by a second fold line between said fourth top closure panel arrangement and said fourth top seal closure panel, said second fold line having a second slit in it, said second slit extending the width of said destacking tab, said second slit being parallel to said first slit, said fourth edge being parallel to said second edge.

8. In the blank of claim 7, the destacking feature of claim 7 wherein said destacking tab has a first perforation at the intersection of said first edge and said fourth edge and wherein said destacking tab has a second perforation at the intersection of said first edge and said second edge.

9. A method for forming an open-topped tapered container having a destacking feature from a blank of foldable sheet material, said blank having a tapered body and a liquid-tight bottom closure arrangement said blank having a side seam area for underlapping and a side seam area for overlapping, said side seam area for underlapping and said side seam area for overlapping adapted to form a sealed side seam area extending the length of said body upon lapping and sealing, said blank having a substantially rectangular abhesive area within said overlapping side seam area, said abhesive area having a width less than the width of said side seam area for overlapping, the method comprising the steps of:

folding said blank into a tubular tapered body;

lapping and sealing said side seam area for overlapping and said side seam area for underlapping to form said sealed side seam area while abhesively preventing the sealing of said abhesive rectangular area, thereby forming a continuous sealed side seam area extending the length of said body;

folding and sealing said liquid-tight bottom closure arrangement; and folding said abhesive rectangular area to protrude in an erect position relative to said side seam area.

10. A method for forming an open-topped tapered container having a destacking feature from a blank of foldable sheet material, said blank having a tapered body and a liquid-tight bottom closure arrangement, said body being joined along fold lines to first, second, third and fourth top closure panel arrangements, said top closure panel arrangements each joined by a fold line to the arrangements adjacent to it, said fourth top closure panel arrangement having a first side seam area for overlapping, said top closure panel arrangements being joined along folded lines to first, second, third and fourth top seal closure panels, said first, second and third top seal closure panels each joined by a fold line to the top seal closure panels adjacent to it, said fourth top seal closure panel having a right-hand portion for overlapping and a left-hand portion for underlapping, said second and fourth top seal closure panels being joined along horizontal fold lines to first and second top seal flaps respectively, said second top seal flap having a second side seam area for overlapping, said right-hand portion of said fourth top seal closure panel being joined by a fold line to a third side seam area for overlapping, said third side seam area for overlapping being joined along a fold line to a first edge of a planer, substantially rectangular, foldably mounted destacking tab, said destacking tab having a horizontally measured width equal to the horizontally measured width of said first side seam area for overlapping, less the horizontally measured width of said third side seam area for overlapping, said destacking tab having an abhesive undersurface, said destacking tab having a substantially horizontal second edge defined by a first fold line between said fourth top seal closure panel and said second top seal flap, said first fold line having a first slit in it, said first slit extending the width of said destacking tab, said destacking tab having a third substantially vertical edge parallel to said first edge, said destacking tab having a fourth edge defined by a second fold line between said fourth top closure panel arrangement and said fourth top seal closure panel, said second fold line having a second slit in it, said second slit extending the width of said destacking tab, said second slit being parallel to said first slit, said fourth edge being parallel to said second edge, the method comprising the steps of:

folding said blank into a tubular tapered body and sealing said first, second, third and fourth side seam areas for overlapping while adhesively preventing the sealing of said destacking tab, and folding and sealing said liquid-tight bottom closure arrangement, and folding said destacking tab along its first edge to protrude away from the body of the container.

11. The method of claim 10 further comprising the steps of perforating said destacking tab at the intersection of said first edge and said fourth edge and perforating said destacking tab at the intersection of said first edge and said second edge.

12. The method of claim 10 further comprising the step of perforating said destacking tab at the intersection of said first edge and said fourth edge.

13. The method of claim 10 further comprising the step of forming an aperture in one of said top seal closure panels, said aperture adapted to receive a straw therethrough for access to the contents of the container.

14. The method of claim 11 further comprising the step of forming an aperture in one of said top seal closure panels, said aperture adapted to receive a straw therethrough for access to the contents of the container.

15. A method for forming an open-topped tapered container having a destacking feature from a blank of foldable sheet material, said blank of foldable sheet material having first, second, third and fourth wall panels, each joined by a fold line to the panels adjacent to it and also joined by fold lines to a rectangular liquid-tight bottom closure arrangement, said fourth wall panel having a first side seam area for overlapping, said wall panels being joined along fold lines to first, second, third and fourth top closure panel arrangements, said top closure panel arrangements each joined by a fold line to the arrangements adjacent to it, said fourth top closure panel arrangement having a second side seam area for overlapping, said top closure panel arrangements being joined along fold lines to first, second, third and fourth top seal closure panels, said first, second and third top seal closure panels each joined by a fold line to the top seal closure panels adjacent to it, said second top seal closure panel being joined along a horizontal fold line to a top seal flap, said fourth top seal closure panel having a right-hand portion for overlapping and a left-hand portion for underlapping, said right-hand portion of said fourth top seal closure panel joined by a substantially vertical fold line to a third side seam area for overlapping, said third side seam area for overlapping being joined along a substantially vertical fold line to a substantially vertical first edge of a planer, substantially rectangular foldably mounted destacking tab, said destacking tab having a horizontally measured width equal to the horizontally measured width of said second side seam area for overlapping less the horizontally measured width of said third side seam area for overlapping, said destacking tab having an abhesive undersurface, said destacking tab having a substantially horizontal second edge defined by the top edge of said right hand portion of said fourth top seal closure panel, said destacking tab having a third edge parallel to said first edge, said destacking tab having a fourth edge defined by the fold line between said fourth closure panel arrangement and said right-hand portion of said fourth top seal closure panel and having a slit in said fold line, said slit extending the width of said destacking tab, the method comprising the steps of:

folding the first, second, third, and fourth wall panels into a tubular, tapered body and sealing said first, second and third side seam areas for overlapping while abhesively preventing the sealing of said destacking tab, and folding and sealing said liquid-tight bottom closure arrangement, and folding said destacking tab along its first edge to protrude away from the body of the container.

16. The method of claim 15 further comprising the step of perforating said destacking tab at the intersection of said first edge and said fourth edge.

17. The method of claim 15 further comprising the step of forming an aperture in one of said top seal closure panels, said aperture adapted to receive a straw therethrough for access to the contents of the container.

18. A method of forming an open-topped tapered container having a destacking feature from a carton blank of foldable sheet material, said blank having first, second, third and fourth wall panels, each joined by a fold line to the panels adjacent to it and also joined by fold lines to a liquid-tight rectangular bottom closure arrangement, said fourth wall panel having a first side seam area for overlapping, said wall panels being joined along fold lines to first, second, third and fourth top closure panel arrangements, said top closure panel arrangements each joined by a fold line to the arrangements adjacent to it, said fourth top closure panel arrangement having a second side seam area for overlapping, said top closure panel arrangements being joined along fold lines to first, second, third and fourth top seal closure panels, said first, second and third top seal closure panels each joined by a fold line to the top seal closure panels adjacent to it, said fourth top seal closure panel having a right-hand portion for overlapping and a left-hand portion for underlapping, said second and fourth top seal closure panels being joined along horizontal fold lines to first and second top seal flaps respectively, said second top seal flap having a third side seam area for overlapping, said right-hand portion of said fourth top seal closure panel being joined by a fold line to a fourth side seam area for overlapping, said fourth side seam area for overlapping being joined along a fold line to a first edge of a planer, substantially rectangular, foldably mounted destacking tab, said destacking tab having a horizontally measured width equal to the horizontally measured width of said second side seam area for overlapping, less the horizontally measured width of said third side seam area for overlapping, said destacking tab having an abhesive undersurface, said destacking tab having a substantially horizontal second edge defined by a first fold line between said fourth top seal closure panel and said second top seal flap, said first fold line having a first slit, said first slit extending the width of said destacking tab, said destacking tab having a third substantially vertical edge parallel to said first edge, said destacking tab having a fourth edge defined by a second fold line between said fourth top closure panel arrangement and said fourth top seal closure panel, said second fold line having a second slit in it, said second slit extending the width of said destacking tab, said second slit being parallel to said first slit, said fourth edge being parallel to said second edge, the method comprising the steps of:

folding said first, second, third and fourth wall panels into a tubular tapered body and sealing said first, second, third and fourth side seam areas for overlapping while abhesively preventing the sealing of said tab, and folding and sealing said liquid-tight bottom closure arrangement, and folding said tab along its first edge to protrude away from the body of the container.

19. The method of claim 18 further comprising the steps of perforating said destacking tab at the intersection of said first edge and said fourth edge and perforating said destacking tab at the intersection of said first edge and said second edge.

20. The method of claim 18 further comprising the step of forming an aperture in one of said top seal closure panels, said aperture adapted to receive a straw therethrough for access to the contents of the container.

21. In a blank of foldable sheet material for a container having a tapered body and a liquid-tight bottom closure arrangement, said body joined along fold lines to first, second, third and fourth top closure panel arrangements, said top closure panel arrangements each joined along fold lines to first, second, third and fourth top seal closure panels each joined by a fold line to the top seal closure panels adjacent to it, said second top seal closure panel being joined along a horizontal fold line to a top seal flap, said fourth top seal closure panel having a right-hand portion for overlapping and a left-hand portion for underlapping, said right-hand portion having a substantially horizontal top edge, said right-hand portion of said fourth top seal closure panel joined by a first substantially vertical fold line to a destacking feature comprising:

a first side seam area for overlapping, said first side seam area for overlapping being joined along a second substantially vertical fold line to a substantially vertical first edge of a planer, substantially rectangular foldably mounted destacking tab, said destacking tab having a horizontally measured width equal to the horizontally measured width of said right-hand portion for overlapping less the horizontally measured width of said first side seam area for overlapping, said destacking tab having an abhesive undersurface.

said destacking tab having a substantially horizontal second edge defined by the top edge of said right-hand portion of said fourth top seal closure panel and extending perpendicularly from said second substantially vertical fold line to a third edge of said destacking tab parallel to said first edge of said destacking tab, said destacking tab having a fourth edge defined by the fold line between said fourth closure panel arrangement and said right-hand portion of said fourth top seal closure panel and having a slit in said fold line, said slit extending the width of said destacking tab from said second substantially vertical fold line to said third edge.

22. In the blank of claim 21, the destacking feature of claim 21 where said destacking tab has a perforation at the intersection of said first edge and said fourth edge.

23. In a blank of foldable sheet material for a tapered container having first, second, third and fourth wall panels, each joined by a fold line to the panels adjacent to it and also joined by fold lines to a rectangular liquid-tight bottom closure arrangement, said fourth wall panel having a first side seam area for overlapping, said wall panels being joined along fold lines to first, second, third and fourth top closure panel arrangements, said top closure panel arrangements each joined by a fold line to the arrangements adjacent to it, said fourth top closure panel arrangement having a second side seam area for overlapping, said top closure panel arrangements being joined along fold lines to first, second, third and fourth top seal closure panels, said first, second and third top seal closure panels each joined by a fold line to the top seal closure panels adjacent to it, said second top seal closure panel being joined along a horizontal fold line to a top seal flap, said fourth top seal closure panel having a right-hand portion for overlapping and a left-hand portion for underlapping, said right-hand portion having a substantially horizontal top edge, said right-hand portion of said fourth top seal closure panel joined by a first substantially vertical fold line to a destacking feature comprising:

a third side seam are for overlapping, said third side seam area for overlapping being joined along a second substantially vertical fold line to a substantially vertical first edge of a planer, substantially rectangular foldably mounted destacking tab, said destacking tab having a horizontally measured width equal to the horizontally measured width of said second side seam area for overlapping less the horizontally measured width of said third side seam area for overlapping, said destacking tab having an abhesive undersurface, said destacking tab having a substantially horizontal second edge defined by the top edge of said right-hand portion of said fourth top seal closure panel, said destacking tab having a third edge parallel to said first edge, said destacking tab having a fourth edge defined by the fold line between said fourth closure panel arrangement and said right-hand portion of said fourth top seal closure panel and having a slit in said fold line, said slit extending the width of said destacking tab.

24. In the blank of claim 23 the destacking feature of claim 23 wherein said destacking tab has a perforation at the intersection of said first edge and said fourth edge.

25. A method for forming an open topped tapered container having a destacking feature from a blank of foldable sheet material, said blank having a tapered body and a liquid-tight bottom closure arrangement, said body being joined along fold lines to first, second, third and fourth top closure panel arrangements, said top closure panel arrangements each joined by a fold line to the arrangements adjacent to it, said fourth top closure panel arrangement having a first side seam area for overlapping, said top closure panel arrangements being joined along fold lines to first, second, third and fourth top seal closure panels, said first, second and third top seal closure panels each joined by a fold line to the top seal closure panels adjacent to it, said second tp seal closure panel being joined along a horizontal fold line to a top seal flap, said fourth top seal closure panel having a right-hand portion for overlapping and a left-hand portion for underlapping, said right-hand portion having a substantially horizontal top edge, said right-hand portion of said fourth top seal closure panel joined by a substantially vertical fold line to a second side seam area for overlapping, said second side seam area for overlapping being joined along a substantially vertical fold line to a substantially vertical first edge of a planer, substantially rectangular foldably mounted destacking tab, said destacking tab having a horizontally measured width equal to the horizontally measured width of said first side seam area for overlapping less the horizontally measured width of said second side seam area for overlapping, said destacking tab having an abhesive undersurface, said destacking tab having a substantially horizontal second edge defined by said top edge of said right-hand portion of said fourth top seal closure panel, said destacking tab having a third edge parallel to said first edge, said destacking tab having a fourth edge defined by the fold line between said fourth closure panel arrangement and said right-hand portion of said fourth top seal closure panel and having a slit in said fold line, said slit extending the width of said tab, the method comprising the steps of:

folding the blank into a tubular, tapered body, and sealing said first and second side seam areas for overlapping while adhesively preventing the sealing of said destacking tab, and folding and sealing said liquid-tight bottom closure arrangement, and folding said destacking tab along its first edge to protrude away from the body of the container.

26. The method of claim 25 further comprising the step of perforating said destacking tab at the intersection of said first edge and said fourth edge.

27. The method of claim 25 further comprising the step of forming an aperture in one of said top seal closure panels, said aperture adapted to receive a straw therethrough for access to the contents of the container.

28. The method of claim 26 further comprising the step of forming an aperture in one of said top seal closure panels, said aperture adapted to receive a straw therethrough for access to the contents of the container.

29. A container fashioned from a single blank of resilient, stiff and foldable sheet material, the container having the general form of a truncated, tapered prism with a closed bottom and an open top, the container being adapted to be nested or stacked with like containers, the container having a side seam running between the top and bottom of the container where two end portions of the blank portion on the outside of the seam and an inner blank portion on the inside of the seam, the outer blank portion being severed along a line perpendicular to the side seam, and the outer blank portion between where it is severed and the top of the container being folded away from the outside of the container to form a denesting projection.

30. The container as claimed in claim 29 wherein the surface on the inside of the outer blank portion that is folded away to form a denesting projection is nonadhering to the surface on the outside of the inner blank portion.

31. A container fashioned from a single blank of resilient, stiff and foldable sheet material, the container having the general form of a truncated, tapered prism with a closed bottom and an open top, the container being adapted to be nested or stacked with like containers, the container having a side seam running between the top and bottom of the container where two end portions of the blank overlap, the two end portions comprising an outer blank portion on the outside of the seam and an inner blank portion on the inside of the seam, the outer blank portion being severed along first and second parallel lines perpendicular to the side seam, and the outer blank portion between the first and second lines along which it is severed being folded away from the outside of the container to form a denesting projection.

32. The container as claimed in claim 31 wherein the inside surface of the outer blank portion between the first and second lines is nonadhering to the surface on the outside of the inner blank portion.

* * * * *

UNITED STATES PATENT AND TRADEMARK OFFICE

CERTIFICATE OF CORRECTION

PATENT NO. : 4,714,164

DATED : December 22, 1987

INVENTOR(S) : George Bachner

It is certified that error appears in the above-identified patent and that said Letters Patent is hereby corrected as shown below:

Column 3, line 8,"tp" should read -- top --;

Column 3, line 48, "bototm" should read -- bottom --;

Claim 21, line 57, after "undersurface", "." should read --, --;

Claim 23, line 30, "are" should read -- area --; and

Claim 25, line 67, "tp" should read -- top --.

Signed and Sealed this

Twenty-seventh Day of December, 1988

*Attest:*

DONALD J. QUIGG

*Attesting Officer*

*Commissioner of Patents and Trademarks*